United States Patent [19]

Wischusen, III

[11] 4,427,147

[45] Jan. 24, 1984

[54] ERECTABLE PAPERBOARD CONTAINER WITH LOCKING FEATURE

[75] Inventor: Henry Wischusen, III, Norcross, Ga.

[73] Assignee: Rock Tenn Company, Norcross, Ga.

[21] Appl. No.: 397,661

[22] Filed: Jul. 12, 1982

[51] Int. Cl.[3] ..... B65D 5/22

[52] U.S. Cl. ..... 229/33

[58] Field of Search ..... 229/32, 33, 34 R, 44 R

[56] References Cited

U.S. PATENT DOCUMENTS

| | | | |
|---|---|---|---|
| 2,597,289 | 5/1952 | Caskey | 229/32 |
| 3,281,054 | 10/1966 | Buttery | 229/51 |
| 3,286,901 | 11/1966 | Anderson | 229/34 R |
| 3,531,041 | 9/1970 | Rahde | 229/34 R |
| 3,533,547 | 10/1970 | Houston | 229/34 R |
| 3,545,666 | 12/1970 | Visrydar | 229/34 R |
| 3,840,172 | 10/1974 | Zimmerman | 229/44 R |
| 4,136,817 | 1/1979 | Perry | 229/34 R |
| 4,279,374 | 7/1981 | Webinger | 229/34 R |

*Primary Examiner*—Herbert F. Ross

*Attorney, Agent, or Firm*—Jones & Askew

[57] ABSTRACT

An erectable container of paperboard or the like has an integral lid and a novel locking mechanism associated with Beers corner structures for retaining the carton in its erected position. Drag tabs pressing against the bottom panel of the box are provided and are trapped between slits cut in the bottom panel. The slits prevent the drag tabs from returning to their collapsed position, but do not permit the drag tabs to protrude outside the container. The container can be easily erected and loaded and is particularly useful for packaging sandwiches and the like.

6 Claims, 4 Drawing Figures

ERECTABLE PAPERBOARD CONTAINER WITH LOCKING FEATURE

TECHNICAL FIELD

The present invention relates to erectable paperboard containers constructed from flat blanks of paperboard material, or the like, and more particularly relates to a container having a locking feature to prevent the corner construction of the container from collapsing once erected.

BACKGROUND ART

Paperboard boxes having attached lids and constructed from a single blank of material are known. Such a container is shown in U.S. Pat. No. 2,210,443. Such containers are useful for protecting many items, including "fast food" sandwiches. The container shown in the referenced patent includes a pair of front corner constructions that are commonly known as "Beers" corners and can be erected from a flat collapsed position to an erected position. However, the normal Beers corner construction includes no locking structure to prevent inadvertent re-collapse of the container during or after loading of the contents. Also, the normal Beers corner tends to sag because of the springiness of the paperboard, so that the container is not held fully open for loading of the contents.

Attempts have been made to lock erectable containers in erected form. For example, in U.S. Pat. No. 1,838,191, inner side walls are folded upwardly against outer side walls to form a double thick side wall. The inner side walls include tabs that catch on ribs extending from the intersecting end walls to hold the inner side walls in position. In U.S. Pat. No. 2,650,751, the side walls themselves are formed to raise upwardly and outwardly as the carton is erected. A special double flap along the front wall of the container catches and traps the side walls in their erected position, and protuberances extending into the container from the back wall tend to trap the rear vertical edge of the side walls.

Locking mechanisms have also been provided in connection with Beers corners. In the typical Beers corner construction, perpendicular wall panels are foldably connected to a bottom panel, and a glue flap is foldably connected to one of the wall panels and adhered to the interior surface of the other wall panel near the top edge of the wall panel. A diagonal score or perforation in the wall panel separates the area adhered to the glue panel from the area below the score or perforation. Prior trays have been provided in which a drag tab extends from the bottom of the glue panel to frictionally engage the bottom panel of the container as the Beers corner is erected. A tab of material is broken out of the bottom panel where it intersects the wall panel beneath the drag tab to leave a cut out opening for receiving the drag tab. Both the tab of material broken out of the bottom panel and the drag tab extend through the cut out opening below the bottom of the box, creating a sometimes undesirable projection which prevents the container from resting flat on its bottom surface. Additional cutouts are provided in the wall panel to which the glue panel is foldably connected in order to accommodate the drag tab when the container is collapsed, since the drag tab would otherwise be jammed in the score between the wall panel and the bottom panel. In such prior art trays, the cutouts for receiving the drag tab when the carton is erected have been placed immediately adjacent to the wall panel, so that it is necessary to force the drag tab completely into the corner between the wall panel and bottom panel in order to insert it into the cutout and thereby lock the corner.

Thus, there has been a need for a locking mechanism associated with Beers corners which can be easily activated and which does not result in the projection of tabs through the bottom of the container.

SUMMARY OF THE INVENTION

The present invention provides an improved paperboard container that can be locked in its erected position, and solves problems associated with prior art locking mechanisms.

Generally described, in a container of paperboard or the like including a Beers corner formed by a bottom panel, front and side wall panels foldably connected to the bottom panel, and a glue flap foldably connected to one of the wall panels and adhered to the interior surface of the other of the wall panels, the glue flap defining a drag tab extending toward the bottom panel, the present invention comprises the improvement of means for retaining the drag tab comprising a slit in the bottom panel under the drag tab and spaced from the other wall panel, the slit trapping the drag tab between the slit and the other wall panel when the carton is erected. The term "slit" when used herein refers to a knife cut in a panel through which a single thickness of the paperboard material will not readily pass at right angles to the panel.

The locking mechanism of the present invention operates effectively and efficiently. When the drag tab is moved across the slit in the bottom panel of the container, the paperboard material of the bottom panel between the slit and the side wall panel gives slightly under the pressure of the drag tab. Thus, the inner edge of the slit prevents the drag tab from moving back toward the interior of the container, even though the drag tab does not pass through the slit. The exterior surface of the bottom panel remains essentially flat, because the drag tab need only depress the bottom panel material slightly in order to be trapped by the slit. The slit can be placed at any selected distance from the side wall panel, so that the drag tab need not be forced flush against the side wall panel in order to activate the locking mechanism.

In a preferred embodiment of the invention, a pair of parallel slits is provided under the drag tab such that the area of the bottom panel between the slits is depressed by the drag tab and the drag tab is trapped between the slits. Also, a slit is provided along the score which foldably connects the bottom panel and the wall panel to which the glue panel of the beers corner is foldably connected, to receive the drag tab and prevent it from being jammed into the bead of this score when the container is in its collapsed position.

The present invention also provides an improved blank for forming a container embodying the invention. The blank is shaped in a novel manner that conserves paperboard and permits efficient nesting of adjacent containers on a single sheet of paperboard.

Thus, it is an object of the present invention to provide an improved paperboard container and blank for forming the same.

It is a further object of the present invention to provide an improved corner construction for an erectable container including a locking mechanism for maintaining the corner construction in an erected position.

It is a further object of the present invention to provide a locking invention for a Beers corner which does not result in the projection of tabs through the bottom panel of the container.

It is a further object of the present invention to provide a locking mechanism for a Beers corner construction that can be easily activated as the container is erected and resists inadvertent re-collapse of the container during loading or use thereof.

It is a further object of the present invention to provide a flat blank for forming a paperboard container, the blank having a novel shape for efficient nesting with adjacent blanks.

Other objects, features and advantages of the present invention will become apparent upon reading the following detailed description of a preferred embodiment of the invention, when taken in conjunction with the drawing and the appended claims.

DETAILED DESCRIPTION OF THE DRAWING

DETAILED DESCRIPTION

Figure 1:
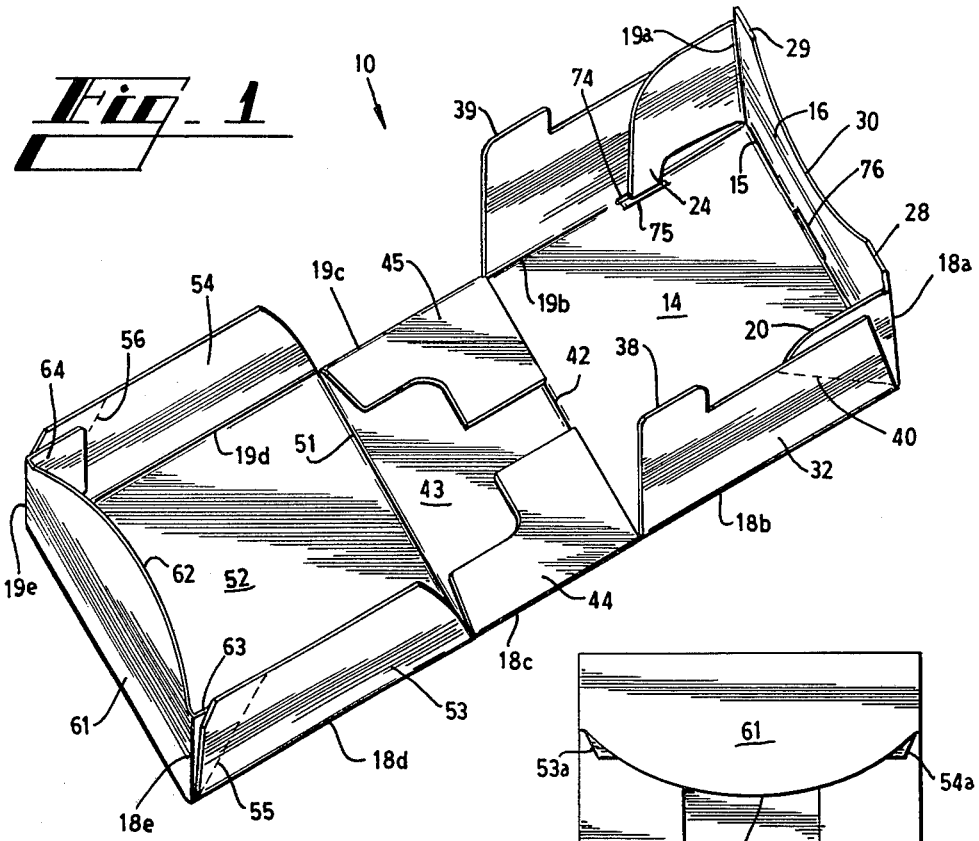
FIG. 1 is a pictorial view of a container embodying the present invention, shown with the corner members erected and locked and with the lid of the container open.
Figure 4:
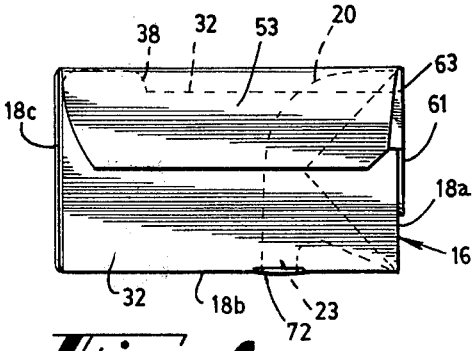
FIG. 4 is a side plan view of a container embodying the present invention in its erected form, shown with the lid closed.
Figure 2:
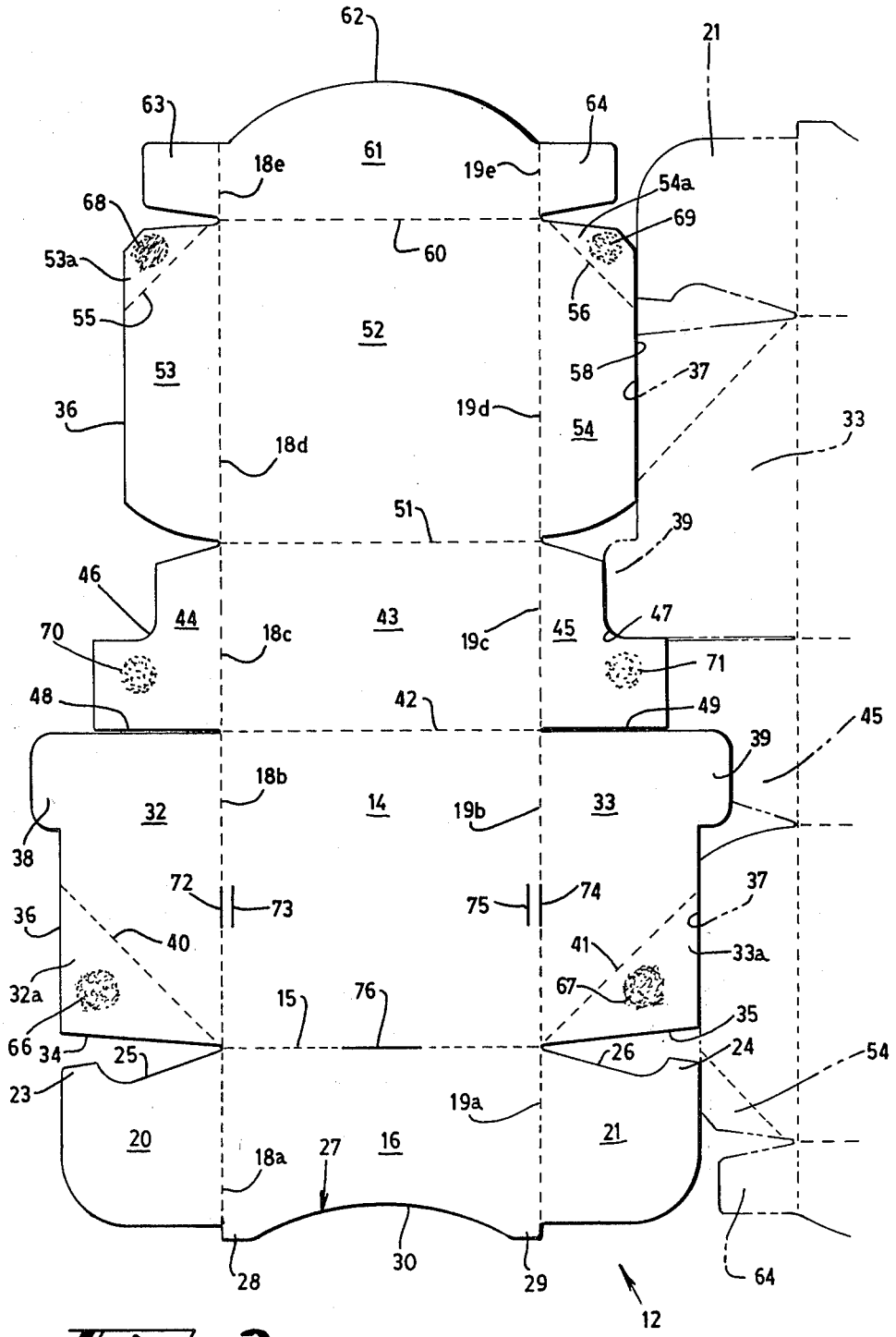
FIG. 2 is a plan view of a flat blank from which a container embodying the present invention is formed.

Referring now in more detail to the drawing, in which like numerals represent like parts throughout the several views, FIG. 1 is a pictorial view of a container 10 embodying the present invention. The container 10 is constructed from a flat blank 12 of paperboard material, or the like, shown in FIG. 2. The container 10 includes a bottom panel 14 which is connected by a transverse score 15 to a front wall panel 16. As seen in FIG. 2, a pair of parallel longitudinal scores 18 and 19 extend the length of the blank 12. The score 18*a* foldably connects the front wall panel 16 to a glue panel 20 which extends transversely away from the front wall panel 16. On the opposite side of the front wall panel 16, a score 19*a* foldably connects the front wall panel 16 to an identical glue panel 21. Cutouts 25 and 26 in the glue panels 20 and 21 define drag tabs 23 and 24 in the glue panels 20 and 21, respectively. The drag tabs 23 and 24 extend longitudinally to a position at least even with the score 15. The front wall panel 16 also has a transverse edge 27 opposite the score 15. The panels 20 and 21 are recessed from the edge 27, which defines with the recessed panels 20 and 21 a pair of projections 28 and 29 extending longitudinally away from the score 15. The projections 28 and 29 are separated by a curved concave cutout 30.

Side wall panels 32 and 33 are foldably connected to the bottom panel 14 along scores 18*b* and 19*b*, respectively. The side wall panels 32 and 33 have front transverse edges 34 and 35 which preferably angle away from the adjacent drag tabs 23 and 24 as the transverse edges extend from the socre 15 away from the bottom panel 14.

The side wall panels 32 and 33 also include longitudinal edges 36 and 37, respectively. The edges 36 and 37 each define a projection 38 and 39, which extend outwardly at the back end of the side wall panel opposite the front transverse edges 34 and 35. The transverse distance between the scores 18*b* and 19*b* and the end of the projections 38 and 39 is equal to the longitudinal distance between the score 15 and projections 28 and 29 of the front panel 16. Thus, when the lid of the container is closed, it rests upon four supports of even height.

The side wall panels 32 and 33 also include diagonal perforations 40 and 41 which form a part of the well known Beers corner construction. The perforation 40 extends from the intersection of the score 15 and the score 18*b* to a point along the longitudinal edge 36 spaced apart from the transverse edge 34. Similarly, the perforation 41 extends from the intersection of the score 15 and the score 19*b* to the longitudinal edge 37. Thus, the perforations 40 and 41 define triangular areas 32*a* and 33*a*. The perforations 40 and 41 are angled with respect to the scores 18 and 19 so as to cause the front wall panel 16 to tilt inwardly when the container is erected.

The bottom panel 14 is also foldably connected by a transverse score 42 to a back wall panel 43. Longitudinal scores 18*c* and 19*c* along opposite edges of the back wall panel 43 foldably connect the panel 43 to reinforcing panels 44 and 45. Cutouts 46 and 47 are provided in the reinforcing panels 44 and 45 in order to receive in nesting relationship a projection 38 or 39 of an adjacent blank. The reinforcing panels 44 and 45 are separated from the longitudinally adjacent side wall panels 32 and 33 by knife cuts 48 and 49 which are colinear with the score 42.

The back wall panel 43 is foldably connected along a transverse score 51 to a top closure panel or lid 52. The lid 52 is foldably connected along longitudinal scores 18*d* and 19*d* to side closure panels 53 and 54. The side closure panels 53 and 54 each include diagonal beers corner performations 55 and 56 which define in the side closure panels triangular areas 53*a* and 54*a*. The lid 52 is also foldably connected along a score 60 to a front closure panel 61 which includes a curved transverse edge 62 shaped for nesting with the curved transverse edge 27 of an adjacent blank. Glue flaps 63 and 64 are foldably connected to the panel 61 along scores 18*e* and 19*e*, and extend outwardly to cooperate with the side closure panels 53 and 54 in the formation of Beers corners.

The bottom panel 14 is provided with a series of slits which cooperate with the drag tabs 23 and 24 to provide a locking mechanism. In the preferred embodiment shown in the drawing, two spaced apart parallel slits 72 and 73 are knife cut through the bottom panel 14 parallel to the score 18*b* and adjacent thereto. The slits 72 and 73 are located such that they are in the path of the drag tab 23 when the container 10 is erected, as will be explained below. A similar pair of slits 74 and 75 is provided parallel and adjacent to the score 19*b* in the path of the drag tab 24. A slit 76 is provided along a central portion of the score 15. When the container is in the collapsed position shown in FIG. 3, the drag tabs 23 and 24 extend toward the score 15, and are able to extend through the slit 76 because the slit opens when the front panel 16 is folded onto the bottom panel 14. This prevents the drag tabs from engaging and being crumpled by the bead of paperboard formed when the adjacent panels are folded along the score 15. If the container 10 is sufficiently wide so that the drag tabs 23 and 24 are spaced apart from one another along the score 15 when the container is collapsed, separate slits 76 can be provided to receive the individual drag tabs.

Figure 3:
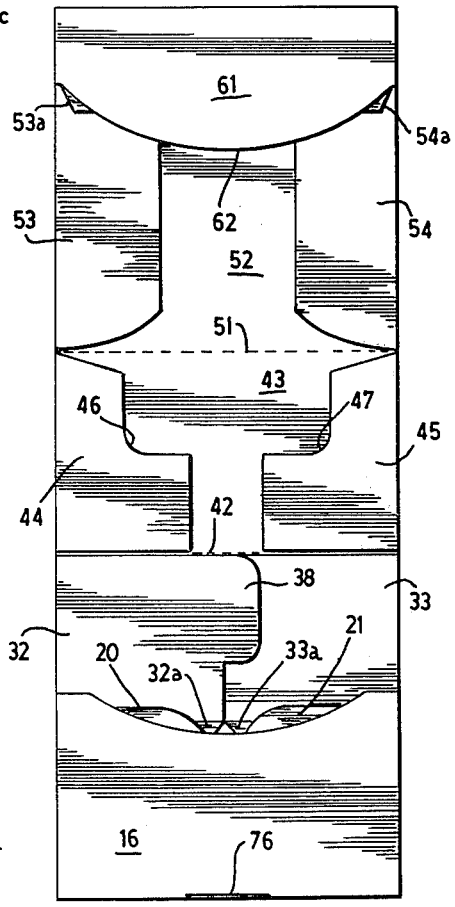
FIG. 3 is a plan view of a container embodying the present invention, shown in its collapsed position.

In order to assemble the container 10 in a collapsed position ready for erection and use, as shown in FIG. 3, conventional folding machinery is utilized to fold the panels 20, 32, 44, 53 and 63 inwardly along the longitudinal score 18 onto the panels 16, 14, 43, 52 and 61, respectively. Similarly, the panels 21, 33, 45, 54 and 64 are folded along the longitudinal score 19 inwardly upon the opposite portions of the same respective panels. Glue spots 70 and 71 are applied to the reinforcing panels 44 and 45 prior to folding thereof. When the reinforcing panels 44 and 45 are folded against the back wall panel 43, they adhere thereto to reinforce the back wall panel with double thickness portions. As a result, no back corner structures are required.

The triangular portions 32*a*, 33*a*, 53*a* and 54*a* are folded about their respective perforations onto the side panels 32, 33, 53 and 54 to expose the same surface of the triangular portions that are exposed in FIG. 2. Glue spots 66, 67, 68 and 69 are then applied to the triangular portions 32*a*, 33*a*, 53*a* and 54*a*. To complete the assembly of the container 10 as shown in FIG. 3, the front wall panel 16 and connected glue panels 20 and 21 are folded inwardly along the score 15 onto the previously folded side wall panels 32 and 33. As explained above, the drag tabs 23 and 24 extend into the slit 76 in the score 15. As a result, the glue panels 20 and 21 are adhered to the triangular portions 32*a* and 33*a* of the side wall panels, forming a pair of Beers corners. Similarly, the front closure panel 61 and connected glue panels 63 and 64 are folded along the score 60 inwardly upon the side closure panels 53 and 54 to form another pair of Beers corners.

The container 10 can be erected from its collapsed position shown in FIG. 3 to its erected position by initially grasping the front wall panel 16 and lifting it to a vertical position. This operation will also raise the side wall panels 32 and 33 to their vertical positions. Then, the glue panels 20 and 21 are urged outwardly toward the side wall panels 32 and 33 until the drag tabs 23 and 24 pass the slits 73 and 75, respectively. Since the scores 40 and 41 of the side wall panels are appropriately angled toward the back of the container, the front wall panel 16 is slightly off vertical, and this causes the drag tabs 23 and 24 to press against the bottom panel 14. Thus, when the drag tabs pass the slits 73 and 75, they depress the area of the bottom panel 14 which lies between the pairs of slits 72, 73 and 74, 75. Because of the depression of this area of the bottom panel 14, the drag tabs cannot escape back past the slits 73 and 75. Therefore, the container remains locked in its erected position during loading and use of the container 10. It will be seen that the slits 73 and 75 can be placed at any desired distance from the side walls 32 and 33, so that the drag tabs can be moved past the slits 73 and 75 with a minimum of effort. It will also be noted that the slits 72 and 74 can be omitted, since the drag tabs will still tend to depress the portion of the bottom panel 14 between the slit 73 or 75 and the side wall panel. However, in the preferred embodiment shown, the slits are provided in pairs to weaken the portion of the bottom panel 14 between the slits to assure a more positive trapping of the drag tab in the locked position. In either case, the drag tab does not protrude through either of the slits, and therefore the exterior surface of the bottom panel 14 remains essentially smooth.

If, for a particular application, it is desirable for the front wall panel 16 to extend vertically at right angles to the bottom panel 14, the drag tabs 23 and 24 can be extended beyond the line of the score 15 so that the drag tabs press upon the bottom panel 14 when the container is erected.

In the assembly of the container as shown in FIG. 3, it is preferable for some applications not to pre-fold the scores 42 and 51. This causes the scores to have more memory when the container is erected, so that the lid tends to stay open so as not to obstruct loading of a product, such as a "fast food" sandwich, into the container.

As shown in FIG. 2, the blank 12 used to form a container 10 is carefully shaped to nest with adjacent blanks and to preserve paperboard. A second blank is shown in phantom lines adjacent to the blank in FIG. 2. It will be seen that the projection 39 of the second blank is matingly received by the cutout 47 of the reinforcing panel 45 of the first blank. The side closure panel 54 of the first blank has a longitudinal edge 58 which is colinear with the longitudinal edge 37 of the second blank. The cutout 47 and the utilization of projections 28, 29, 38 and 39 allow the blanks to be moved transversely closer together than if the side wall panels were of even height along their edges, by a distance equal to the height of the projections 38 and 39. Thus, this amount of paperboard is saved along the entire length of the blank. Adjacent blanks also nest longitudinally, since the curved edge 62 of the front closure panel 61 can be matingly received within an adjacent cutout 30 of a front wall panel 16. Of course, a series of blanks can be nested upon a single large sheet of paperboard.

While this invention has been described in detail with particular reference to a preferred embodiment thereof, it will be understood that variations and modifications can be effected within the spirit and scope of the invention as described above and as defined in the appended claims.

I claim:

1. In a collapsible container of paperboard or the like including a Beers corner formed by a bottom panel, front and side wall panels foldably connected to the bottom panel, and a glue flap foldably connected to one of the wall panels and adhered to the interior surface of the other of the wall panels, said glue flap defining a drag tab extending toward the bottom panel, the improvement comprising:

means for retaining said drag tab comprising a slit in said bottom panel under the path of said drag tab and spaced from said other wall panel, said slit trapping said drag tab between said slit and said other wall panel; and means for receiving said drag tab when said container is collapsed comprising a slit defined along the intersection of said bottom panel and the wall panel to which said glue flap is connected.

2. The container of claim 1, wherein said means for retaining said drag tab comprises a pair of slits in said bottom panel adjacent to said other wall panel, said drag tab being trapped between said slits.

3. A collapsible container of paperboard or the like, comprising:

a bottom panel having a front edge and a pair of side edges;

a front wall panel foldably connected to said front edge of said bottom panel;

a pair of side wall panels foldably connected to said side edges of said bottom panel;

Beers corner means connecting said side and front wall panels, comprising a pair of glue panels foldably connected to said front wall panel and adhered to the interior surfaces of said side wall panels, said glue panels defining drag tabs extending toward said bottom panel, and diagonal score lines defined in said side wall panels;

said bottom panel defining means for retaining said drag tabs comprising a slit adjacent to each of said side edges under the paths of said drag tabs, said drag tabs being trapped between said slits and said side wall panels when said Beers corner means are erected; and means for receiving said drag tabs when said container is collapsed comprising at least one slit defined along the intersection of said bottom and front wall panels.

4. The container of claim 3, wherein said means for retaining said drag tabs comprises two pairs of slits adjacent to each of said side edges under said drag tabs, said drag tabs being trapped between said slits when said Beers corner means are erected.

5. The container of claim 3, further comprising a back wall panel foldably connected along a bottom edge thereof to a rear edge of said bottom panel; a top closure foldably connected to said back wall panel along a top edge thereof; and reinforcing panels foldably connected to said back wall panel along opposite side edges thereof, said reinforcing panels being adhered to said back wall panel.

6. A paperboard blank for forming a pair of containers, each container comprising:

a bottom panel;

side wall panels connected to said bottom panel and including projections extending beyond the outer edge of the remainder of said side wall panels;

a back wall panel connected to said bottom panel along an edge of said bottom panel adjacent to said projections;

a pair of flaps extending outwardly from opposite sides of said back wall panel;

a top closure extending outwardly from said back wall panel opposite to said bottom panel, said top closure including a top panel and a pair of upper side panels extending outwardly from opposite side edges of said top panel; and a front wall panel connected to said bottom panel;

said containers being oriented on said blank at 180° with respect to one another such that the outer edges of said remainders of each of said side walls of said containers are adjacent to one of said upper side panels of the other container, and said projections are matingly received by cutouts defined in said flaps, the outer edge of the remainder of each of said side walls being positioned outwardly beyond the outer edge of the upper side panel that is attached to the same side of the same container to which said side wall is attached.

* * * * *